US005671692A

United States Patent [19]

Kimball

[11] Patent Number: 5,671,692

[45] Date of Patent: Sep. 30, 1997

[54] BOAT FENDER

[75] Inventor: William C. Kimball, Gloversville, N.Y.

[73] Assignee: N.A. Taylor Co., Inc., Gloversville, N.Y.

[21] Appl. No.: 222,861

[22] Filed: Apr. 5, 1994

[51] Int. Cl.[6] ..... B63B 59/02

[52] U.S. Cl. ..... 114/219

[58] Field of Search ..... 114/219; 405/212, 405/215; D12/168

[56] References Cited

U.S. PATENT DOCUMENTS

| | | | |
|---|---|---|---|
| D. 219,893 | 2/1971 | Simpton et al. | D12/168 |
| D. 259,194 | 5/1981 | Koughan | D12/168 |
| 708,476 | 9/1902 | Higgins | 114/219 |
| 2,905,129 | 9/1959 | Denend et al. | 114/219 |
| 3,121,888 | 2/1964 | Morgan et al. | 114/219 |
| 3,292,566 | 12/1966 | Russell | 114/219 |
| 4,664,053 | 5/1987 | Mesinger | 114/219 |
| 4,843,994 | 7/1989 | Wilson et al. | 114/219 |

FOREIGN PATENT DOCUMENTS

| | | | |
|---|---|---|---|
| 1151958 | 8/1983 | Canada . | |
| 319362 | 6/1989 | European Pat. Off. | 114/219 |
| 647886 | 10/1962 | Italy . | |
| 5-39085 | 2/1993 | Japan . | |
| 80590 | 8/1952 | Norway . | |

OTHER PUBLICATIONS

Nelson A. Taylor Co., Inc., "Taylor Made" Brochure, (1993) p. 3.

1993 Nelson A. Taylor Co., Inc. catalog pp. 3–5, 7–10.

*Primary Examiner*—Sherman Basinger

*Attorney, Agent, or Firm*—Nixon & Vanderhye P.C.

[57] ABSTRACT

A boat fender is particularly constructed to provide protection where needed on low freeboard boats with a minimum of rolling. The fender includes a substantially cylindrical body portion having first and second ends and an axis of elongation, and an ear portion integral with the body portion at its first end and making an angle of about 45°–100° (e.g. 90°) with respect to the axis of elongation. Both the body portion and the ear portion are of resilient material, such as resilient plastic, and are typically hollow. An opening is provided in the ear portion large enough to receive a line therein for tying the fender to a cleat or support on a boat or dock. The contour between the ear portion and the body portion roughly conforms to the gunwale of a low freeboard boat. The fender may be attached to a boat, or it may be attached to a dock, so as to protect the boat from impacting the dock.

19 Claims, 2 Drawing Sheets

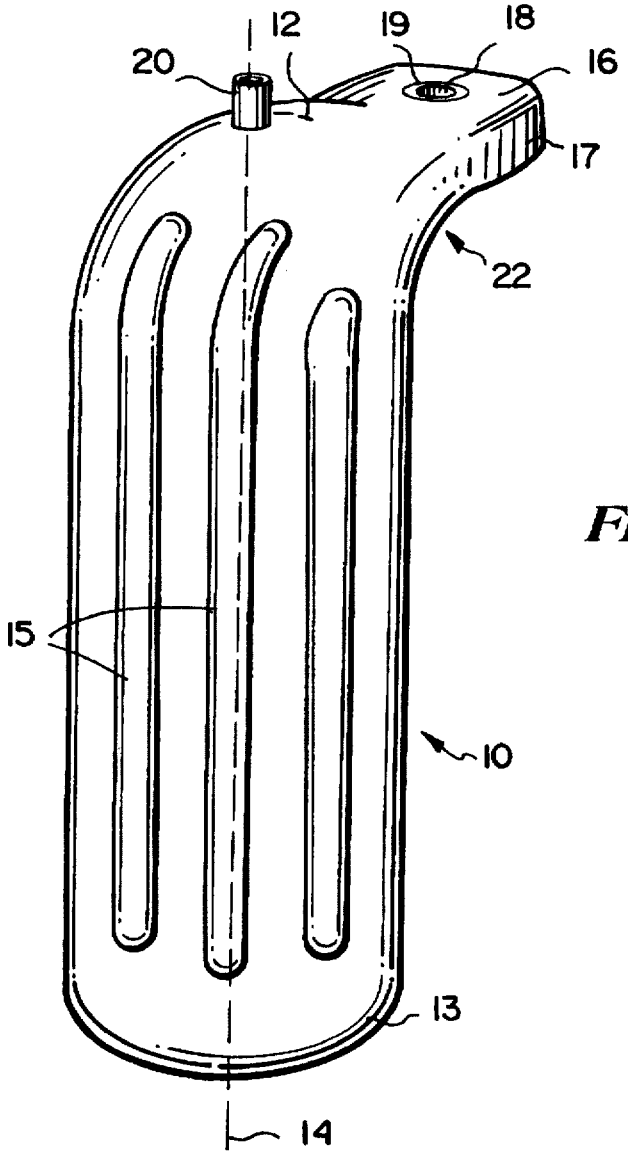
Fig. 1
Fig. 2
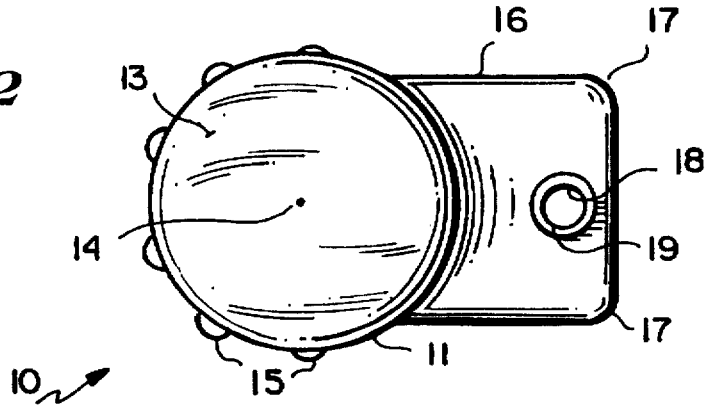

BOAT FENDER

BACKGROUND AND SUMMARY OF THE INVENTION

Boat fenders are common marine accessories for protecting boats from docks or like stationary objects, and vice versa. Conventional boat fenders are of resilient plastic (typically hollow and either sealed or inflatable) and often have ears at one or both ends thereof which extend generally in the axis of elongation of the cylindrical fender body. The ears have openings through which a line may be passed to tie the fender to a cleat, rail, dock support, or the like. While conventional fenders are very effective in protecting most types of boats, providing cushioning between a gunwale and other boats or stationary objects by cushioning any impact, low freeboard boats—such as bass boats and others commonly used by sport fishermen—are not always properly protected. Low freeboard boats are low in the water so that the bottoms of conventional fenders contact the water and due to the inherent buoyancy of the fender (which floats easily), the fenders tend to float sideways along the boat reducing the effectiveness of the fender. Also on fixed docks the gunwales of low freeboard boats are often lower than the dock generally horizontal portion (platform), which can easily result in the boat crashing into a dock in such a way that conventional fenders do not provide much or sufficient protection.

According to the present invention, a boat fender is provided which adequately provides fendering for the gunwales and sides of low freeboard boats of most types. The fender according to the present invention is constructed in such a way that there is a minimum tendency for the fender to slide up and away from the side of a boat, and the fender is shaped to protect the top of the gunwale and to curve down to protect the sides of the boat. The boat fender according to the present invention will remain in protecting position on a low freeboard boat under normal conditions.

According to one aspect of the present invention a boat fender comprises a body portion and an ear portion integral with the body portion and both of resilient material. The body portion is substantially cylindrical and has first and second ends, and an axis of elongation. The ear portion is provided at the first end of the body and makes an angle of about 45° or more with respect to the axis of elongation. The ear extends with respect to the body so that they are contoured to provide protection where needed (typically the gunwale and sides) with a minimum of rolling, yet while providing this protection the fender according to the present invention does not have a configuration that looks or is used in a manner substantially different than for conventional fenders, and thus is familiar to and readily utilized by most boaters. Also the fender may readily be constructed utilizing conventional rotational molding or injection molding techniques.

An opening is provided in the ear portion. The opening (which may be reinforced, e.g with a metal eyelet) is large enough to receive a line therein for tying the fender to a cleat or support on a boat or dock. The ear preferably is squared off at the end thereof remote from where it is integral with the body portion, to minimize the tendency of the fender to slide away from the side of a boat to which it has been connected. The fender is made of conventional resilient plastic and is hollow, and the body may include fluting or ribbing. The ear portion typically makes an angle of about 45°–100° with respect to the axis of elongation, preferably about 90°. The second end of the fender, opposite the first end, preferably is rounded and earless, and the fender has a length such that when tied onto a cleat of a low freeboard boat with the ear portion overlying the gunwale, the second end of the fender is not immersed in water an amount sufficient to result in adverse positioning of the fender as a result of its inherent buoyancy.

According to another aspect of the present invention a method is provided of protecting the gunwale and sides of a low freeboard boat. The method comprises the steps of: (a) Positioning the fender over the gunwale of a low freeboard boat, exteriorly thereof, so that the cylindrical body portion hangs down from the gunwale, and so that the ear portion is essentially on top of the gunwale so that the contour of the body and ear portions conforms to the gunwale of the low freeboard boat. And, (b) releasably fixing the fender in the location at which it has been positioned in step (a). The fender has an opening in the ear portion large enough to receive a line therein, and step (b) is practiced by passing a line through the opening in the ear portion and securing the line to a cleat on the low freeboard boat. Steps (a) and (b) are preferably practiced so that the end of the body portion opposite the ear portion does not immerse in water an amount that would adversely affect the positioning of the fender due to the inherent buoyancy thereof.

According to another aspect of the present invention a method of protecting the gunwale and sides of low freeboard boats from damage by impacting a dock having a generally horizontal portion and side portions, and vice versa using a boat fender, comprises the following steps: (a) Positioning the fender on the dock so that the cylindrical body portion hangs substantially vertically down along a side portion of the dock at which low freeboard boats are likely to impact the dock, and so that the ear portion overlies a generally horizontal portion of the dock. And, (b) releasably fixing the fender in the position in which it has been positioned in step (a). The fender has an opening in the ear portion large enough to receive a line therein, and step (b) is practiced by passing a line through the opening in the ear portion and securing the line to a cleat or support on the dock at or above the generally horizontal portion.

It is the primary object of the present invention to provide an advantageous boat fender, for protecting low freeboard boats, and methods of utilization thereof. This and other objects of the invention will become clear from an inspection of the detailed description of the invention and from the appended claims.

BRIEF DESCRIPTION OF THE DRAWINGS

FIG. 1 is an isometric view of an exemplary boat fender according to the present invention;

FIG. 2 is a bottom plan view of the fender of FIG. 1;

DETAILED DESCRIPTION OF THE DRAWINGS

Figure 3:
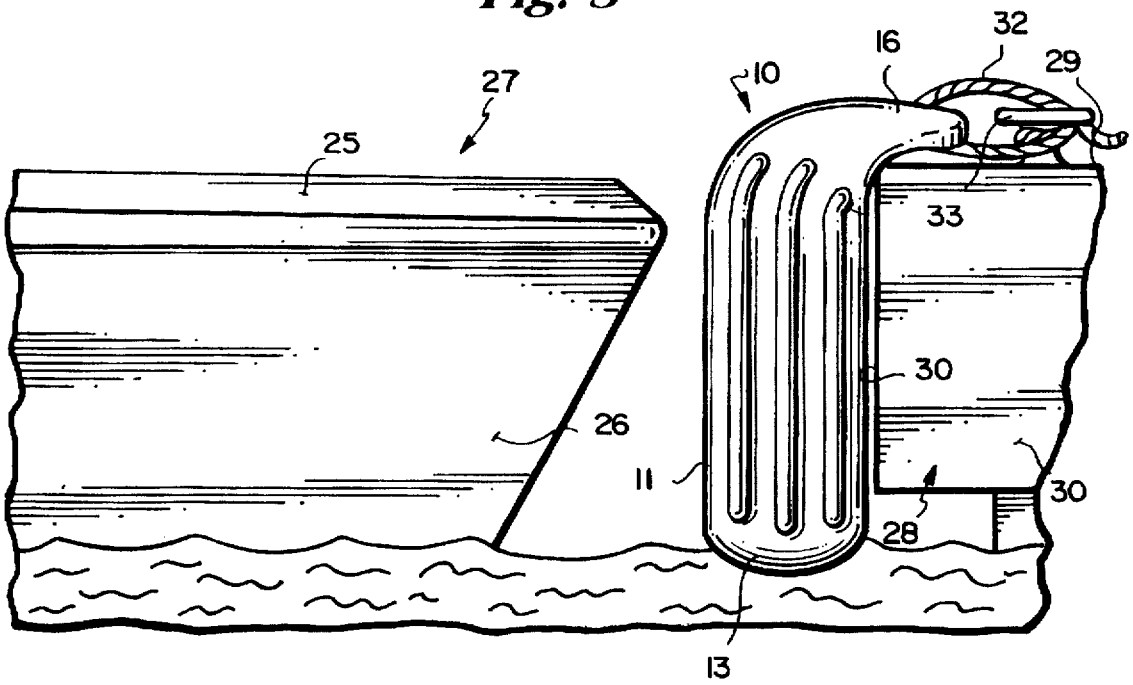
FIG. 3 is a side view showing the fender of FIGS. 1 and 2 used on a dock to protect low freeboard boats from impacting the dock, and vice versa.
Figure 4:
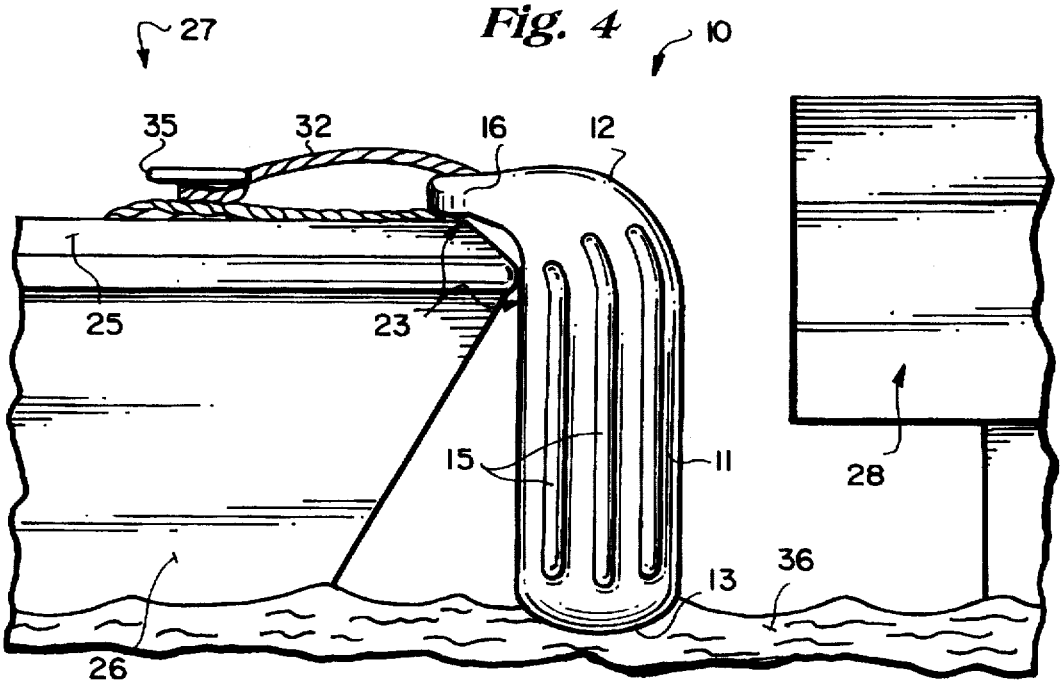
FIG. 4 is a side view of the fender of FIGS. 1 and 2 shown connected to a low freeboard boat to protect the gunwale and sides thereof.

An exemplary buoyant boat fender according to the present invention is shown generally by reference numeral 10 in FIGS. 1 through 4. The fender includes a substantially cylindrical body portion 11 which has a shape and dimensions similar to that of conventional cylindrical boat fenders, and made of resilient material, such as a resilient plastic that is hollow. The body portion 11 has a first end 12 and a second end 13 spaced from each other along the axis of elongation 14 of the body portion 11. Flutes or ribbing 15 may be provided in the body portion 11, typically generally parallel to the axis of elongation 14 as illustrated in FIGS. 1, 3, and 4.

Integral with the first end 12 (typically the top end in use of the fender 10) of the fender 10 is an ear portion 16, typically made of the same resilient plastic as the body portion 11, and also typically hollow, although it may be solid. As seen most clearly in FIGS. 1 and 2, the end of the ear portion 16 most remote from where it is integral with the first end 12 of the body portion 11 is squared off as indicated at 17, this "squaring off" minimizes the tendency of the fender 10 to slide up and away from the side of a boat to which it is attached. Preferably an opening 18 is provided in the ear 16, the opening 18 also extending generally parallel to the axis 14. A reinforcing eyelet 19, as seen in FIGS. 1 and 2, may be provided defining the opening 18. The opening 18 has dimensions sufficient for a conventional line used with boats or docks to pass therethrough to facilitate attachment of the fender 10 to a cleat, rail, support, or the like.

As seen in FIGS. 1 and 2, the fluting or ribbing 15 is provided along the body 11 except where the ear portion 16 overhangs the body 11.

In the embodiment illustrated in the drawings, the second end 13 is rounded and earless. However under some circumstances an ear—like a conventional ear of a conventional cylindrical fender (that is extending generally along the axis of elongation 14), or a duplicate of ear 16—could be provided.

The fender 10 preferably is constructed with a sealed configuration, that is the resilient plastic forming the body portion 11 and the integral ear 16 completely sealing the hollow interior thereof from the ambient atmosphere. However if desired the fender could be of the inflatable type, including having an inflation valve 20 (see FIG. 1) of conventional construction associated therewith.

The fender ear portion 16 makes an angle with respect to the axis of elongation 14 such that a contoured area 22 is provided at the junction between the body portion 11 and the ear portion 16 which roughly conforms to the construction of a gunwale of a low freeboard boat, so as to provide protection where needed on low freeboard boats (e.g. the gunwale and sides) with a minimum of rolling. Typically, the angle 23—see FIG. 4—between the ear portion 16 and the axis of elongation 14 (or a line parallel thereto) is about 45° or more, typically about 45°–100°, and preferably roughly about 90°. A roughly 90° angle is illustrated in FIGS. 1 through 4.

FIG. 3 illustrates a method of protecting the gunwale and sides of low freeboard boats, such as the gunwale 25 and side 26 of the bass boat 27, from damage by impacting a dock 28. The dock has a generally horizontal portion (platform 29), and typically also has sides, or at least supporting poles, such as the sides 30 seen in FIG. 3. The method is practiced by positioning the fender 10 on the dock 28 as illustrated in FIG. 3 so that the body portion 11 hangs substantially vertically down along a side portion 30 of the dock 28 at which low freeboard boats 27 are likely to impact the dock, and so that the ear portion 16 overlies the platform 29, and then tying the fender 10 in the position illustrated in FIG. 3. The typing step is preferably accomplished by passing a line (e.g. rope) 32 through the opening 18 in the ear 16, and then tying the line 32 to a cleat 33, rail, support, pole, or like attachment object associated with the dock 28.

FIG. 4 illustrates a method of protecting the gunwale 25 and sides 26 of a low freeboard boat 27 using the fender 10. As illustrated in FIG. 4, the fender 10 is positioned over the gunwale 25, exteriorly of the boat 27, so that the cylindrical body portion 11 hangs down from the gunwale 25, and so that the ear portion 16 is essentially on top of the gunwale 25 so that the contour 22 of the body and ear portions 11, 16 roughly conforms to the gunwale 25. The fender 10 is then tied or otherwise releasably affixed in the position illustrated in FIG. 4. This is preferably accomplished by passing the line 32 through the opening 18 in the ear 16, and tying the line 32 to a cleat 35 on the boat 27.

Preferably, the length of the fender 10, particularly from the "bottom" of the ear portion 16 (when the fender 10 has the typical use orientation illustrated in FIGS. 3 and 4) to the second end 13, is such that when the ear portion 16 overlies the gunwale 25 of the low freeboard boat 27 (as seen in FIG. 4) the second end 13 does not immerse in the water 36 a sufficient amount to adversely affect the positioning of the fender 10 due to the inherent buoyancy of the fender 10.

It is noted that utilizing the fender 10 in the manner illustrated in FIG. 4 the top of the gunwale 25 is also protected even if the low freeboard boat 27 should pass under the platform 29 of a dock 28, and be moved by waves up toward the bottom of the dock 28. The squared off configuration 17 of the ear 16 also minimizes the tendency of the fender 10 to slide away from the side 26 or gunwale 25 of the boat 27 to which it has been attached.

It will thus be seen that according to the present invention a boat fender, and methods of utilization thereof, have been provided which are particularly effective for protecting low freeboard boats. Despite the efficiency of the protection provided by the fender according to the invention, it has a basically familiar and user-friendly configuration, and it may be made by conventional rotational molding or injection molding techniques using conventional boat fender plastics.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A buoyant boat fender comprising a body portion and an ear portion integral with said body portion, and both of resilient material;

said body portion being substantially cylindrical and having first and second ends, and an axis of elongation;

said ear portion being provided at said first end of said body, and making a substantially fixed angle of about 45–100 degrees with respect to said axis of elongation;

an opening provided in said ear portion large enough to receive a line therein for tying said fender to a cleat or support on a boat or dock, said opening extending substantially perpendicular to said ear portion; and wherein said second end of said body portion is rounded and earless.

2. A buoyant boat fender as recited in claim 1 wherein said ear portion has a squared end remote from where it is integral with said body portion to minimize the tendency of said fender to slide away from the side of a boat to which it is connected.

3. A buoyant boat fender as recited in claim 2 wherein said ear portion extends with respect to said body portion so that they are contoured to provide protection where needed on low freeboard boats with a minimum of rolling.

4. A buoyant boat fender as recited in claim 2 wherein said ear portion makes an angle of about 90 degrees with respect to said axis of elongation.

5. A buoyant boat fender as recited in claim 1 wherein said body and ear portions are made of resilient plastic, and are hollow, and wherein said body portion includes fluting or ribbing along said body except where said ear portion overhangs said body.

6. A buoyant boat fender as recited in claim 1 wherein said ear portion extends with respect to said body portion so that said ear and body portions are contoured to provide protection where needed on low freeboard boats with a minimum of rolling.

7. A buoyant boat fender as recited in claim 1 wherein said ear portion makes an angle of about 90 degrees with respect to said axis of elongation.

8. A buoyant boat fender as recited in claim 1 wherein said fender has a length such that when said ear portion overlies a gunwale of a low freeboard boat said second end of said body portion does not immerse in the water a sufficient amount to adversely affect the positioning of said fender due to the inherent buoyancy of said fender.

9. A method of protecting the gunwale and sides of a low freeboard boat, using a buoyant boat fender having a substantially cylindrical body portion of resilient material, and an integral ear portion extending outwardly from one end of the body portion and fixed in orientation with respect to the body portion, and forming a contour with the body portion to roughly conform to the gunwale of a low freeboard boat and wherein the fender has an opening in the ear portion substantially perpendicular to the ear portion, and large enough to receive a line therein, comprising the steps of:

(a) positioning the fender over the gunwale of a low freeboard boat, exteriorly thereof, so that the cylindrical body portion hangs down from the gunwale, and so that the ear portion is essentially on top of the gunwale so that the contour of the body and ear portions conforms to the gunwale of the low freeboard boat; and (b) releasably fixing the fender in the location at which it has been positioned in step (a) by passing a line through the opening in the ear portion, and securing the line to a cleat on the low freeboard boat.

10. A method as recited in claim 9, wherein steps (a) and (b) are practiced so that the end of the body portion opposite the ear portion does not immerse in water an amount that would adversely affect the positioning of the fender due to the inherent buoyancy thereof.

11. A method as recited in claim 9 wherein said ear portion has a squared end remote from where it is integral with said body portion; and wherein step (b) is practiced to secure the ear portion squared end so that it minimizes the tendency of the fender to slide away from the gunwale of the low freeboard boat.

12. A buoyant boat fender comprising a body portion and a substantially flat ear portion integral with said body portion, and both of resilient material;

said body portion being substantially cylindrical and having first and second ends, and an axis of elongation;

said substantially flat ear portion being provided at said first end of said body and making a substantially fixed angle of about 45°–100° with respect to said axis of elongation; and said substantially flat ear portion having a squared end remote from where it is integral with said body portion to minimize the tendency of said body portion to slide away from the side of a boat to which it is connected.

13. A buoyant boat fender as recited in claim 12 wherein said body and ear portions are made of resilient plastic, and are hollow, and wherein said body portion includes fluting or ribbing along said body except where said ear portion overhangs said body.

14. A buoyant boat fender comprising a body portion and a substantially flat ear portion integral with said body portion, and both of resilient material;

said body portion being substantially cylindrical and having first and second ends, and an axis of elongation;

said substantially flat ear portion being provided at said first end of said body and making a substantially fixed angle of about 45° or more with respect to said axis of elongation;

said substantially flat ear portion having a squared end remote from where it is integral with said body portion to minimize the tendency of said body portion to slide away from the side of a boat to which it is connected; and wherein said body and ear portions are made of resilient plastic, and are hollow, and wherein said body portion includes fluting or ribbing along said body except where said ear portion overhangs said body.

15. A buoyant boat fender as recited in claim 14 wherein said ear portion makes an angle of about 90° with respect to said axis of elongation.

16. A buoyant boat fender comprising a body portion and an ear portion integral with said body portion, and both of resilient material;

said body portion being substantially cylindrical and having first and second ends, and an axis of elongation;

said ear portion being provided at said first end of said body, and making a substantially fixed angle of about 45 degrees or more with respect to said axis of elongation;

an opening provided in said ear portion large enough to receive a line therein for tying said fender to a cleat or support on a boat or dock, said opening extending substantially perpendicular to said ear portion; and wherein said body and ear portions are made of resilient plastic, and are hollow, and wherein said body portion includes fluting or ribbing along said body except where said ear portion overhangs said body.

17. A buoyant boat fender as recited in claim 16 wherein said ear portion has a squared end remote from where it is integral with said body portion to minimize the tendency of said fender to slide away from the side of a boat to which it is connected.

18. A buoyant boat fender as recited in claim 17 wherein said body and ear portions are made of resilient plastic, and are hollow, and wherein said body portion includes fluting or ribbing.

19. A buoyant boat fender as recited in claim 17 wherein said fender has a length such that when said ear portion overlies a gunwale of a low freeboard boat and second end of said body portion does not immerse in the water a sufficient amount to adversely affect the positioning of said fender due to the inherent buoyancy of said fender.

* * * * *